US012226815B2

(12) United States Patent
Zhan et al.

(10) Patent No.: US 12,226,815 B2
(45) Date of Patent: Feb. 18, 2025

(54) METHODS FOR EXTRUDING COARSE-GRAINED, LOW ALUMINUM CONTENT MAGNESIUM ALLOYS

(71) Applicant: GM GLOBAL TECHNOLOGY OPERATIONS LLC, Detroit, MI (US)

(72) Inventors: Henry Zhan, Shanghai (CN); Congjie Wang, Shanghai (CN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 81 days.

(21) Appl. No.: 17/872,766

(22) Filed: Jul. 25, 2022

(65) Prior Publication Data

US 2023/0381845 A1 Nov. 30, 2023

(30) Foreign Application Priority Data

May 27, 2022 (CN) ..... 202210588657.9

(51) Int. Cl.
*B21C 23/00* (2006.01)
*C22C 23/00* (2006.01)
(Continued)

(52) U.S. Cl.
CPC ..... *B21C 23/002* (2013.01); *B21C 23/001* (2013.01); *C22C 23/00* (2013.01); *C22C 23/02* (2013.01); *C22F 1/06* (2013.01)

(58) Field of Classification Search
CPC ..... B21C 23/002; C22C 23/00; C22C 23/02; C22F 1/06
See application file for complete search history.

(56) References Cited

U.S. PATENT DOCUMENTS

2008/0000557 A1* 1/2008 Ghosh ..... C22F 1/06 148/420
2009/0028743 A1* 1/2009 Gupta ..... B21C 23/002 72/364
(Continued)

FOREIGN PATENT DOCUMENTS

CN 114686710 A 7/2022
CN 114908278 A 8/2022
(Continued)

OTHER PUBLICATIONS

First Office Action for German Patent Application No. 10 2022 118 222.3 issued on Jun. 1, 2023, with correspondence from Manitz Finsterwald Patent—und Rechtsanwaltspartnerschaft mbB summarizing Office Action; 7 pages.
(Continued)

*Primary Examiner* — Adil A. Siddiqui
(74) *Attorney, Agent, or Firm* — Harness, Dickey & Pierce, P.L.C.

(57) ABSTRACT

The present disclosure provides a method of forming an extruded billet from a coarse-grained magnesium alloy billet. The method includes extruding the coarse-grained magnesium alloy biller at temperatures greater than or equal to about 300° C. to less than or equal to about 360° C. to from the extruded billet. The coarse-grained magnesium alloy billet has an average grain size greater than or equal to about 800 μm, and has a low aluminum content. The coarse-grained magnesium alloy billet includes greater than or equal to about 0.5 wt. % to less than or equal to about 3 wt. % of aluminum. The extruded billet may have a plurality of twins with lenticular morphology, which occupies an area fraction greater than or equal to about 20% of a total area of the extruded billet.

18 Claims, 4 Drawing Sheets

(51) Int. Cl.
*C22C 23/02* (2006.01)
*C22F 1/06* (2006.01)

(56) References Cited

U.S. PATENT DOCUMENTS

| | | | |
|---|---|---|---|
| 2020/0354818 | A1 | 11/2020 | Sherman et al. |
| 2022/0205068 | A1 | 6/2022 | Zhan et al. |
| 2023/0050499 | A1 | 2/2023 | Zhan et al. |

FOREIGN PATENT DOCUMENTS

| | | | |
|---|---|---|---|
| CN | 117161116 | A | 12/2023 |
| DE | 102020129422 | A1 | 6/2021 |
| DE | 102022118222 | A1 | 11/2023 |

OTHER PUBLICATIONS

Zhan, Henry et al.: U.S. Appl. No. 17/481,641, filed Sep. 22, 2021; entitled "Method to Form Axisymmetric Magnesium Article by Forging and Flow-Forming Process"; 30 pages.

* cited by examiner

METHODS FOR EXTRUDING COARSE-GRAINED, LOW ALUMINUM CONTENT MAGNESIUM ALLOYS

CROSS-REFERENCE TO RELATED APPLICATIONS

This application claims the benefit and priority of Chinese Application No. 202210588657.9 filed May 27, 2022. The entire disclosure of the above application is incorporated herein by reference.

INTRODUCTION

This section provides background information related to the present disclosure which is not necessarily prior art.

Lightweight metal components have become an important focus for manufacturing vehicles, especially automobiles, where continual improvement in performance and fuel efficiency is desirable. While conventional steel and other metal alloys provide various performance benefits, including high strength, such materials can be heavy. Lightweight metal components for automotive applications are often made of aluminum and/or magnesium alloys. Such lightweight metals can form load-bearing components that are strong and stiff, while having good strength and ductility (e.g., elongation). High strength and ductility are particularly important for safety requirements and durability in vehicles like automobiles.

While magnesium-based alloys are an example of lightweight metals that can be used to form structural components in a vehicle, in practice, the use of magnesium-based alloys may be limited. For example, although it is often desirable to reduce aluminum content for magnesium-base alloys to improve formability of the magnesium-based alloys. The reduction of aluminum can negatively affect grain refinement during casting, such that magnesium-based alloys having small amounts of aluminum often have coarse-grained microstructures. In certain variations, coarse-grained microstructures can be refined to improve forgeability by using extrusion processes having temperatures great than about or exactly 380° C. with large aspect ratio (e.g., greater than or equal to about or exactly 15). However, in the instance of products (e.g., road wheel) formed by conduct forging on extruded billets with large diameters (e.g., greater than or equal to about or exactly 200 mm), extrusion ratios are limited (e.g., less than or equal to about or exactly 5). As such, in these instances, coarse-grained microstructure cannot be readily refined using conventional extrusion processes, for example, because of limited plastic deformation degree and small grain boundary fractions in the original microstructure, limiting the number of dynamic recrystallization (DRX), or nucleation, sites. Accordingly, it would be desirable to develop processes that improve the forgeability of magnesium-based alloys having coarse-grained microstructures.

SUMMARY

This section provides a general summary of the disclosure, and is not a comprehensive disclosure of its full scope or all of its features.

The present disclosure relates to methods for extruding coarse-grained magnesium alloys to form extruded billets.

In various aspects, the present disclosure provides a method of forming an extruded billet from a coarse-grained magnesium alloy billet. The method includes extruding the coarse-grained magnesium alloy billet at temperatures less than or equal to about 360° C. to form the billet. The coarse-grained magnesium alloy billet may have an average grain size greater than or equal to about 800 μm.

In one aspect, the coarse-grained magnesium alloy billet may be extruded at temperatures greater than or equal to about 300° C.

In one aspect, the coarse-grained magnesium alloy billet may have a low aluminum content. The coarse-grained magnesium alloy billet may include greater than or equal to about 0.5 wt. % to less than or equal to about 3 wt. % of aluminum.

In one aspect, the coarse-grained magnesium alloy billet may include about 2 wt. % of aluminum.

In one aspect, the coarse-grained magnesium alloy billet may include greater than or equal to about 0.3 wt. % to less than or equal to about 0.6 wt. % of manganese.

In one aspect, the coarse-grained magnesium alloy billet may include about 0.5 wt. % of manganese.

In one aspect, the coarse-grained magnesium alloy billet may include at least one of: greater than 0 wt. % to less than or equal to about 3 wt. % of zinc, greater than 0 wt. % to less than or equal to about 3 wt. % of tin, greater than 0 wt. % to less than or equal to about 0.5 wt. % of calcium, and greater than 0 wt. % to less than or equal to about 5 wt. % of the rare earth metals.

In one aspect, the coarse-grained magnesium alloy billet may include about 1 wt. % of zinc.

In one aspect, the extruded billet may include a plurality of twins with lenticular morphology.

In one aspect, the plurality of twins with lenticular morphology may occupy an area fraction greater than or equal to about 20% of a total area of the extruded billet.

In one aspect, an article prepared from the extruded billet may include a plurality of twin-induced dynamic recrystallization grains.

In one aspect, the twin-induced dynamic recrystallization grains may occupy an area fraction greater than or equal to about 20% of a total area of the as-prepared article.

In one aspect, the as-prepared article may include greater than or equal to about 20% of boundaries with misorientations of greater than or equal to about 60 degrees to less than or equal to about 100 degrees.

In various aspects, the present disclosure provides a method of forming a forged component. The method may include preparing an extruded billet from an aluminum-lean magnesium alloy billet by extruding the aluminum-lean magnesium alloy billet at temperatures less than or equal to about 360° C. to form the extruded billet. The aluminum-lean magnesium alloy billet may have an average grain size greater than or equal to about 800 μm. The extruded billet may be incorporated into the forged component.

In one aspect, the method may further include, after the extruding, moving the extruded billet through a forging die having an opening that corresponds to a cross-sectional geometry of the forged component.

In one aspect, the extruding may be conducted at temperatures greater than or equal to about 300° C.

In one aspect, the aluminum-lean magnesium alloy billet may include greater than or equal to about 0.5 wt. % to less than or equal to about 3 wt. % of aluminum.

In one aspect, the aluminum-lean magnesium alloy billet may include greater than or equal to about 0.3 wt. % to less than or equal to about 0.6 wt. % of manganese, greater than or equal to about 0 wt. % to less than or equal to about 3 wt. % of zinc, greater than or equal to about 0 wt. % to less than or equal to about 3 wt. % of tin, greater than or equal to about 0 wt. % to less than or equal to about 0.5 wt. % of calcium, and greater than or equal to about 0 wt. % to less than or equal to about 5 wt. % of the rare earth metals.

In one aspect, the extruded billet may include a plurality of twins with lenticular morphology.

In one aspect, the plurality of twins with lenticular morphology may occupy an area fraction greater than or equal to about 20% of a total area of the extruded billet.

In one aspect, the forged component may include a plurality of twin-induced dynamic recrystallization grains.

In one aspect, the twin-induced dynamic recrystallization grains may occupy an area fraction greater than or equal to about 20% of a total area of the forged component.

In one aspect, the forged component may include greater than or equal to about 20% of boundaries with misorientations of greater than or equal to about 60 degrees to less than or equal to about 100 degrees.

In various aspects, the present disclosure provides a method of forming an extruded billet from a coarse-grained magnesium alloy billet. The method may include moving the coarse-grained magnesium alloy billet through an extruding die at temperatures greater than or equal to about 300° C. to less than or equal to about 360° C. to form the billet. The coarse-grained magnesium alloy billet may include greater than or equal to about 0.5 wt. % to less than or equal to about 3 wt. % of aluminum. The coarse-grained magnesium alloy billet may have an average grain size greater than or equal to about 800 μm.

In one aspect, the extruded billet may include a plurality of twins with lenticular morphology.

In one aspect, the plurality of twins with lenticular morphology may occupy an area fraction greater than or equal to about 20% of a total rea of the extruded billet.

In one aspect, the extruded billet may be used to prepare an article that includes a plurality of twin-induced dynamic recrystallization grains.

In one aspect, the twin-induced dynamic recrystallization grains may occupy an area fraction greater than or equal to about 20% of a total area of the as-prepared article.

In one aspect, the as-prepared article may include greater than or equal to about 20% of boundaries with misorientations of greater than or equal to about 60 degrees to less than or equal to about 100 degrees.

In one aspect, the coarse-grained magnesium alloy billet may further include greater than or equal to about 0.3 wt. % to less than or equal to about 0.6 wt. % of manganese.

In one aspect, the coarse-grained magnesium alloy billet may further include at least one: greater than 0 wt. % to less than or equal to about 3 wt. % of zinc, greater than 0 wt. % to less than or equal to about 3 wt. % of tin, greater than 0 wt. % to less than or equal to about 0.5 wt. % of calcium, and greater than 0 wt. % to less than or equal to about 5 wt. % of the rare earth metals.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
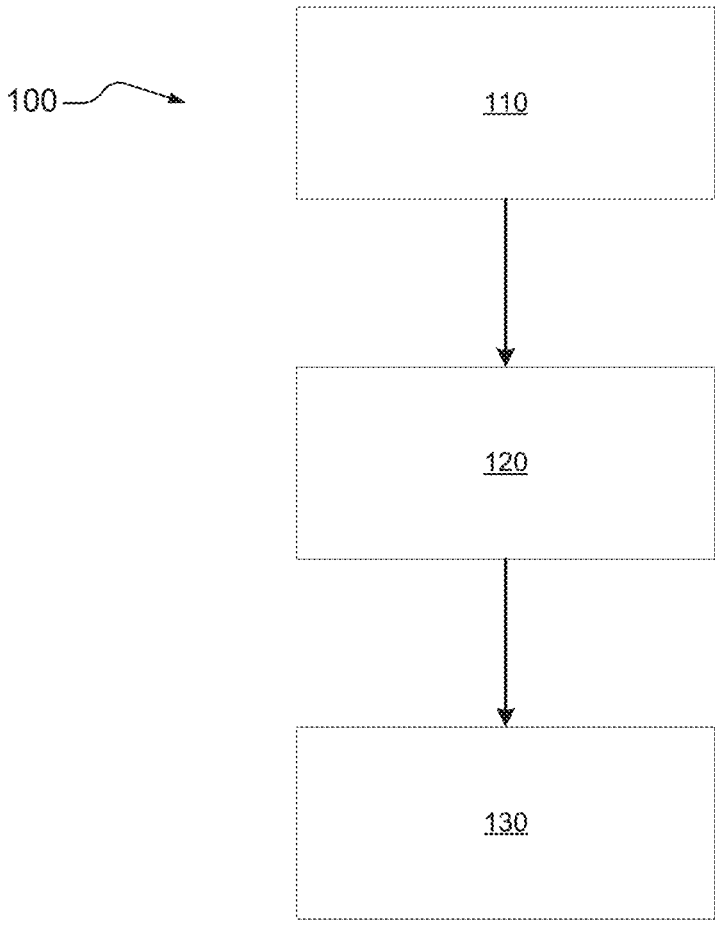
FIG. 1 is a flowchart illustrating an example method for preparing an extruded billet from a coarse-grained, aluminum-lean magnesium alloy billet in accordance with various aspects of the present disclosure.

Example embodiments are provided so that this disclosure will be thorough, and will fully convey the scope to those who are skilled in the art. Numerous specific details are set forth such as examples of specific compositions, components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, elements, compositions, steps, integers, operations, and/or components, but do not preclude the presence or addition of one or more other features, integers, steps, operations, elements, components, and/or groups thereof. Although the open-ended term "comprising," is to be understood as a non-restrictive term used to describe and claim various embodiments set forth herein, in certain aspects, the term may alternatively be understood to instead be a more limiting and restrictive term, such as "consisting of" or "consisting essentially of." Thus, for any given embodiment reciting compositions, materials, components, elements, features, integers, operations, and/or process steps, the present disclosure also specifically includes embodiments consisting of, or consisting essentially of, such recited compositions, materials, components, elements, features, integers, operations, and/or process steps. In the case of "consisting of," the alternative embodiment excludes any additional compositions, materials, components, elements, features, integers, operations, and/or process steps, while in the case of "consisting essentially of," any additional compositions, materials, components, elements, features, integers, operations, and/or process steps that materially affect the basic and novel characteristics are excluded from such an embodiment, but any compositions, materials, components, elements, features, integers, operations, and/or process steps that do not materially affect the basic and novel characteristics can be included in the embodiment.

Any method steps, processes, and operations described herein are not to be construed as necessarily requiring their performance in the particular order discussed or illustrated, unless specifically identified as an order of performance. It is also to be understood that additional or alternative steps may be employed, unless otherwise indicated.

When a component, element, or layer is referred to as being "on," "engaged to," "connected to," or "coupled to" another element or layer, it may be directly on, engaged, connected, or coupled to the other component, element, or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various steps, elements, components, regions, layers and/or sections, these steps, elements, components, regions, layers and/or sections should not be limited by these terms, unless otherwise indicated. These terms may be only used to distinguish one step, element, component, region, layer or section from another step, element, component, region, layer, or section. Terms such as "first," "second," and other numerical terms when used herein do not imply a sequence or order unless clearly indicated by the context. Thus, a first step, element, component, region, layer, or section discussed below could be termed a second step, element, component, region, layer or section without departing from the teachings of the example embodiments.

Spatially or temporally relative terms, such as "before," "after," "inner," "outer," "beneath," "below," "lower," "above," "upper," and the like, may be used herein for ease of description to describe one element or feature's relationship to another element(s) or feature(s) as illustrated in the figures. Spatially or temporally relative terms may be intended to encompass different orientations of the device or system in use or operation in addition to the orientation depicted in the figures.

Throughout this disclosure, the numerical values represent approximate measures or limits to ranges to encompass minor deviations from the given values and embodiments having about the value mentioned as well as those having exactly the value mentioned. Other than in the working examples provided at the end of the detailed description, all numerical values of parameters (e.g., of quantities or conditions) in this specification, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. For example, "about" may comprise a variation of less than or equal to 5%, optionally less than or equal to 4%, optionally less than or equal to 3%, optionally less than or equal to 2%, optionally less than or equal to 1%, optionally less than or equal to 0.5%, and in certain aspects, optionally less than or equal to 0.1%.

In addition, disclosure of ranges includes disclosure of all values and further divided ranges within the entire range, including endpoints and sub-ranges given for the ranges.

Example embodiments will now be described more fully with reference to the accompanying drawings.

The present disclosure relates to extruded billets prepared from coarse-grained, aluminum-lean magnesium alloys, and in particular, from coarse-grained, aluminum-lean magnesium alloy billets. Coarse-grained, aluminum-lean magnesium alloy billets may have an average grain size greater than or equal to about or exactly 800 μm. The coarse-grained magnesium alloys include one or more magnesium alloys. Magnesium alloys in accordance with various aspects of the present disclosure include aluminum (Al) and manganese (Mn). In certain variations, the magnesium alloys may also include zinc (Zn), tin (Sn), and/or calcium (Ca). In still other variations, the magnesium alloys may also include rare earth metals, such as one or more of the elements of the lanthanide series and/or yttrium (Y). For example, the coarse-grained magnesium alloys may include certain combinations of aluminum, manganese, zinc, tin, calcium, and rare earth metals. An example magnesium alloy may consist essentially of magnesium, aluminum, and manganese. Another example magnesium alloy may consist essentially of magnesium, aluminum, and manganese, and also at least one of zinc, tin, calcium, and one or more rare earth metals. That is, the example magnesium alloys may exclude additional compositions, materials, components, elements, and/or features that materially affect the basic and novel characteristic of the example magnesium alloy, but any compositions, materials, components, elements, and/or features that do not materially affect the basic and novel characteristics of the example magnesium alloy can be included.

In certain variations, the magnesium alloys may have a low aluminum content. For example, the magnesium alloys may include greater than or equal to about or exactly 0.5 wt. % to less than or equal to about or exactly 3 wt. % of aluminum. The magnesium alloys may include greater than or equal to about or exactly 0.5 wt. %, optionally greater than or equal to about or exactly 0.6 wt. %, optionally greater than or equal to about or exactly 0.7 wt. %, optionally greater than or equal to about or exactly 0.8 wt. %, optionally greater than or equal to about or exactly 0.9 wt. %, optionally greater than or equal to about or exactly 1 wt. %, optionally greater than or equal to about or exactly 1.1 wt. %, optionally greater than or equal to about or exactly 1.2 wt. %, optionally greater than or equal to about or exactly 1.3 wt. %, optionally greater than or equal to about or exactly 1.4 wt. %, optionally greater than or equal to about or exactly 1.5 wt. %, optionally greater than or equal to about or exactly 1.6 wt. %, optionally greater than or equal to about or exactly 1.7 wt. %, optionally greater than or equal to about or exactly 1.8 wt. %, optionally greater than or equal to about or exactly 1.9 wt. %, optionally greater than or equal to about or exactly 2.0 wt. %, optionally greater than or equal to about or exactly 2.1 wt. %, optionally greater than or equal to about or exactly 2.2 wt. %, optionally greater than or equal to about or exactly 2.3 wt. %, optionally greater than or equal to about or exactly 2.4 wt. %, optionally greater than or equal to about or exactly 2.5 wt. %, optionally greater than or equal to about or exactly 2.6 wt. %, optionally greater than or equal to about or exactly 2.7 wt. %, optionally greater than or equal to about or exactly 2.8 wt. %, and in certain aspects, optionally greater than or equal to about or exactly 2.9 wt. %. of aluminum. The magnesium alloys may include less than or equal to about or exactly 3 wt. %, optionally less than or equal to about or exactly 2.9 wt. %, optionally less than or equal to about or exactly 2.8 wt. %, optionally less than or equal to about or exactly 2.7 wt. %, optionally less than or equal to about or exactly 2.6 wt. %, optionally less than or equal to about or exactly 2.5 wt. %, optionally less than or equal to about or exactly 2.4 wt. %, optionally less than or equal to about or exactly 2.3 wt. %, optionally less than or equal to about or exactly 2.2 wt. %, optionally less than or equal to about or exactly 2.1 wt. %, optionally less than or equal to about or exactly 2.0 wt. %, optionally less than or equal to about or exactly 1.9 wt. %, optionally less than or equal to about or exactly 1.8 wt. %, optionally less than or equal to about or exactly 1.7 wt. %, optionally less than or equal to about or exactly 1.6 wt. %, optionally less than or equal to about or exactly 1.5 wt. %, optionally less than or equal to about or exactly 1.4 wt. %, optionally less than or equal to about or exactly 1.3 wt. %, optionally less than or equal to about or exactly 1.2 wt. %, optionally less than or equal to about or exactly 1.1 wt. %, optionally less than or equal to about or exactly 1 wt. %, optionally less than or equal to about or exactly 0.9 wt. %, optionally less than or equal to about or exactly 0.8 wt. %, optionally less than or equal to about or exactly 0.7 wt. %, and in certain aspects, optionally less than or equal to about or exactly 0.6 wt. %.

In certain variations, the magnesium alloys may include greater than or equal to about or exactly 0.3 wt. % to less than or equal to about or exactly 0.6 wt. % of manganese. For example, the magnesium alloys may include greater than or equal to about or exactly 0.3 wt. %, optionally greater than or equal to about or exactly 0.35 wt. %, optionally greater than or equal to about or exactly 0.4 wt. %, optionally greater than or equal to about or exactly 0.45 wt. %, optionally greater than or equal to about or exactly 0.5 wt. %, and in certain aspects, optionally greater than or equal to about or exactly 0.55 wt. %, of manganese. The magnesium alloys may include less than or equal to about or exactly 0.6 wt. %, optionally less than or equal to about or exactly 0.55 wt. %, optionally less than or equal to about or exactly 0.5 wt. %, optionally less than or equal to about or exactly 0.45 wt. %, optionally less than or equal to about or exactly 0.4 wt. %, and in certain aspects, optionally less than or equal to about or exactly 0.35 wt. %, of manganese.

In certain variations, the magnesium alloys may include greater than or equal to about or exactly 0 wt. % to less than or equal to about or exactly 3 wt. % of zinc. For example, the magnesium alloys may include greater than or equal to about or exactly 0 wt. %, optionally greater than or equal to about or exactly 0.05 wt. %, optionally greater than or equal to about or exactly 0.1 wt. %, optionally greater than or equal to about or exactly 0.5 wt. %, optionally greater than or equal to about or exactly 1 wt. %, optionally greater than or equal to about or exactly 1.5 wt. %, optionally greater than or equal to about or exactly 2.0 wt. %, and in certain aspects, optionally greater than or equal to about or exactly 2.5 wt. %, of zinc. The magnesium alloys may include less than or equal to about or exactly 3 wt. %, optionally less than or equal to about or exactly 2.5 wt. %, optionally less than or equal to about or exactly 2 wt. %, optionally less than or equal to about or exactly 1.5 wt. %, optionally less than or equal to about or exactly 1 wt. %, optionally less than or equal to about or exactly 0.5 wt. %, and in certain aspects, optionally less than or equal to about or exactly 0.1 wt. %, of zinc.

In certain variations, the magnesium alloys may include greater than or equal to about or exactly 0 wt. % to less than or equal to about or exactly 3 wt. % of tin. For example, the magnesium alloys may include greater than or equal to about or exactly 0 wt. %, optionally greater than or equal to about or exactly 0.05 wt. %, optionally greater than or equal to about or exactly 0.1 wt. %, optionally greater than or equal to about or exactly 0.5 wt. %, optionally greater than or equal to about or exactly 1 wt. %, optionally greater than or equal to about or exactly 1.5 wt. %, optionally greater than or equal to about or exactly 2.0 wt. %, and in certain aspects, optionally greater than or equal to about or exactly 2.5 wt. %, of tin. The magnesium alloys may include less than or equal to about or exactly 3 wt. %, optionally less than or equal to about or exactly 2.5 wt. %, optionally less than or equal to about or exactly 2 wt. %, optionally less than or equal to about or exactly 1.5 wt. %, optionally less than or equal to about or exactly 1 wt. %, optionally less than or equal to about or exactly 0.5 wt. %, and in certain aspects, optionally less than or equal to about or exactly 0.1 wt. %, of tin.

In certain variations, the magnesium alloys may include greater than or equal to about or exactly 0 wt. % to less than or equal to about or exactly 0.5 wt. % of calcium. For example, the magnesium alloys may include greater than or equal to about or exactly 0 wt. %, optionally greater than or equal to about or exactly 0.05 wt. %, optionally greater than or equal to about or exactly 0.1 wt. %, greater than or equal to about or exactly 0.15 wt. %, greater than or equal to about or exactly 0.2 wt. %, greater than or equal to about or exactly 0.25 wt. %, greater than or equal to about or exactly 0.3 wt. %, greater than or equal to about or exactly 0.35 wt. %, greater than or equal to about or exactly 0.4 wt. %, and in certain aspects, greater than or equal to about or exactly 0.45 wt. %, of calcium. The magnesium alloys may include less than or equal to about or exactly 0.5 wt. %, optionally less than or equal to about or exactly 0.45 wt. %, optionally less than or equal to about or exactly 0.4 wt. %, optionally less than or equal to about or exactly 0.35 wt. %, optionally less than or equal to about or exactly 0.3 wt. %, optionally less than or equal to about or exactly 0.25 wt. %, optionally less than or equal to about or exactly 0.2 wt. %, optionally less than or equal to about or exactly 0.15 wt. %, optionally less than or equal to about or exactly 0.1 wt. %, and in certain aspects, optionally less than or equal to about or exactly 0.05 wt. %, of calcium.

In certain variations, the magnesium alloys may include greater than or equal to about or exactly 0 wt. % to less than or equal to about or exactly 5 wt. % of the rare earth metals. For example, the magnesium alloys may include greater than or equal to about or exactly 0 wt. %, optionally include greater than or equal to about or exactly 0.5 wt. %, optionally include greater than or equal to about or exactly 1 wt. %, optionally include greater than or equal to about or exactly 1.5 wt. %, optionally include greater than or equal to about or exactly 2.0 wt. %, optionally include greater than or equal to about or exactly 2.5 wt. %, optionally include greater than or equal to about or exactly 3 wt. %, optionally include greater than or equal to about or exactly 3.5 wt. %, optionally include greater than or equal to about or exactly 4 wt. %, and in certain aspects, optionally include greater than or equal to about or exactly 4.5 wt. %, of the rare earth metals. The magnesium alloys may include less than or equal to about or exactly 5 wt. %, optionally less than or equal to about or exactly 4.5 wt. %, optionally less than or equal to about or exactly 4.0 wt. %, optionally less than or equal to about or exactly 3.5 wt. %, optionally less than or equal to about or exactly 3.0 wt. %, optionally less than or equal to about or exactly 2.5 wt. %, optionally less than or equal to about or exactly 2.0 wt. %, optionally less than or equal to about or exactly 1.5 wt. %, optionally less than or equal to about or exactly 1 wt. %, and in certain aspects, optionally less than or equal to about or exactly 0.5 wt. %, of the rare earth metals.

In each variation, the magnesium alloys include a balance of magnesium. For example, the magnesium alloys may include greater than or equal to about or exactly 85 wt. %, optionally greater than or equal to about or exactly 86 wt. %, optionally greater than or equal to about or exactly 87 wt. %, optionally greater than or equal to about or exactly 88 wt. %, optionally greater than or equal to about or exactly 89 wt. %, optionally greater than or equal to about or exactly 90 wt. %, optionally greater than or equal to about or exactly 91 wt. %, optionally greater than or equal to about or exactly 92 wt. %, optionally greater than or equal to about or exactly 93 wt. %, optionally greater than or equal to about or exactly 94 wt. %, optionally greater than or equal to about or exactly 95 wt. %, optionally greater than or equal to about or exactly 96 wt. %, optionally greater than or equal to about or exactly 97 wt. %, or in certain aspects, optionally greater than or equal to about or exactly 98 wt. %, of magnesium.

In each variation, the magnesium alloys may also include trace amounts of other elements, such as, for example only, beryllium (Be) and/or strontium (Sr), that do not materially affect the basic characteristic of the magnesium alloys. For example, the magnesium alloys may include less than or equal to about or exactly 1.5 wt. %, optionally less than or equal to about or exactly 1.4 wt. %, optionally less than or equal to about or exactly 1.3 wt. %, optionally less than or equal to about or exactly 1.2 wt. %, optionally less than or equal to about or exactly 1.1 wt. %, optionally less than or equal to about or exactly 1.0 wt. %, optionally less than or equal to about or exactly 0.9 wt. %, optionally less than or equal to about or exactly 0.8 wt. %, optionally less than or equal to about or exactly 0.7 wt. %, optionally less than or equal to about or exactly 0.6 wt. %, optionally less than or equal to about or exactly 0.5 wt. %, optionally less than or equal to about or exactly 0.4 wt. %, optionally less than or equal to about or exactly 0.3 wt. %, optionally less than or equal to about or exactly 0.2 wt. %, optionally less than or equal to about or exactly 0.1 wt. %, or in certain aspects, amounts that are not detectable.

In various aspects, the present disclosure provides methods for forming extruded billets from coarse-grained, low aluminum magnesium alloys, and in particular, from coarse-grained, low aluminum magnesium alloy billets. The methods include, for example, extruding the coarse-grained magnesium alloy billet at temperatures greater than or equal to about or exactly 300° C. to less than or equal to about or exactly 360° C. For example, the coarse-grained magnesium alloy billet may be extruded at temperatures greater than or equal to about or exactly 300° C., optionally greater than or equal to about or exactly 305° C., greater than or equal to about or exactly 310° C., greater than or equal to about or exactly 315° C., greater than or equal to about or exactly 320° C., greater than or equal to about or exactly 325° C., greater than or equal to about or exactly 330° C., greater than or equal to about or exactly 335° C., greater than or equal to about or exactly 340° C., greater than or equal to about or exactly 345° C., greater than or equal to about or exactly 350° C., and in certain aspects, optionally greater than or equal to about or exactly 355° C. The coarse-grained magnesium alloy billet may be extruded at temperatures less than or equal to about or exactly 360° C., optionally less than or equal to about or exactly 355° C., optionally less than or equal to about or exactly 350° C., optionally less than or equal to about or exactly 345° C., optionally less than or equal to about or exactly 340° C., optionally less than or equal to about or exactly 335° C., optionally less than or equal to about or exactly 330° C., optionally less than or equal to about or exactly 325° C., optionally less than or equal to about or exactly 320° C., optionally less than or equal to about or exactly 315° C., optionally less than or equal to about or exactly 310° C., and in certain aspects, optionally less than or equal to about or exactly 305° C. As would be recognized by the skilled artisan, extruding is a process where metal, in a flowable form, is passed through a confined region, such as a die, to form an intermediate billet having a standard shape or cross section, whereas forging is a high pressure process that includes, for example, moving the intermediate billet through a die to form a final complex three-dimensional forged component or part.

As illustrated in FIG. 1, an example method 100 for forming an extruded billet from a coarse-grained, low aluminum magnesium alloy billet may include heating 120 the coarse-grain, low aluminum magnesium alloy billet to a temperature greater than or equal to about or exactly 300° C. to less than or equal to about or exactly 360° C., and extruding 130 the heated coarse-grained, low aluminum magnesium alloy billet to form the extruded billet. In certain variations, the extruding 130 may occur at a ram speed greater than or equal to about or exactly 0.5 mm/s to less than or equal to about or exactly 3 mms. In certain variations, the extruding 130 may have an extrusion ratio greater than or equal to about or exactly 2 to less than or equal to about 5.

Figure 2:
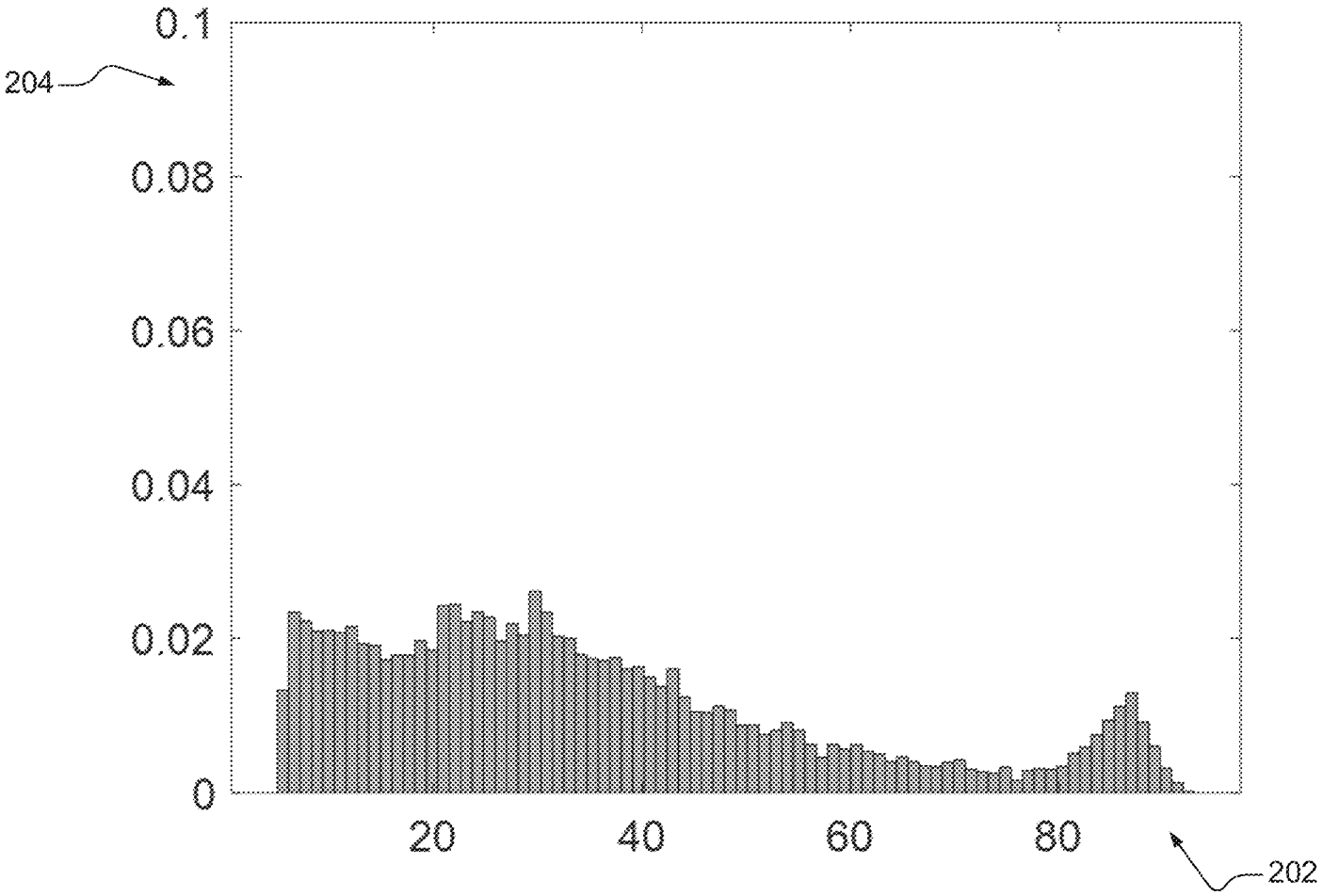
FIG. 2 is a graphical illustration demonstrating the frequency of boundary misorientation for an article prepared from an example extruded billet, where the example extruded billet is prepared from a coarse-grained magnesium alloy billet using an extrusion process having temperatures greater than or equal to about or exactly 300° C. to less than or equal to about or exactly 360° C. in accordance with various aspects of the present disclosure.

As a result of the low-temperature extrusion process, the extruded billets may each have a plurality of twins in lenticular morphology within the magnesium matrix that define the extruded billet. In the subsequent forging processes, the twin morphologies can be transformed such that the microstructure of the formed magnesium article includes twin-induced dynamic recrystallization grains. The twin morphologies may occupy an area fraction greater than or equal to about or exactly 20% of a total area of the extruded billets prepared in accordance with various aspects of the present disclosure. In certain variations, the twins in lenticular morphology may have a boundary misorientation that is greater than or equal to about or exactly 60 degrees to less than or equal to about 100 degrees. As illustrated in FIG. 2, where the x-axis 202 represents misorientation angle in degree and the y-axis 204 represents frequency, a fraction of boundaries with misorientation of between 60 degrees and 100 degrees may account for greater than or equal to about or exactly 20% of all boundaries. In each variation, the twins formed in extruded billet can act as nucleation sites for dynamic recrystallization of fine grains during subsequent forging processes.

In various aspects, the method 100 may include forming 110 the coarse-grained, low aluminum magnesium alloy billet. Forming 110 the coarse-grained, low aluminum magnesium alloy may include a casting process, for example, using a direct-chill casting process and/or a semi-continuous casting process. In each variation, the extruded billet may have an average diameter greater than or equal to about or exactly 200 mm, and in certain variations, optionally greater than or equal to about or exactly 300 mm.

Figure 3:
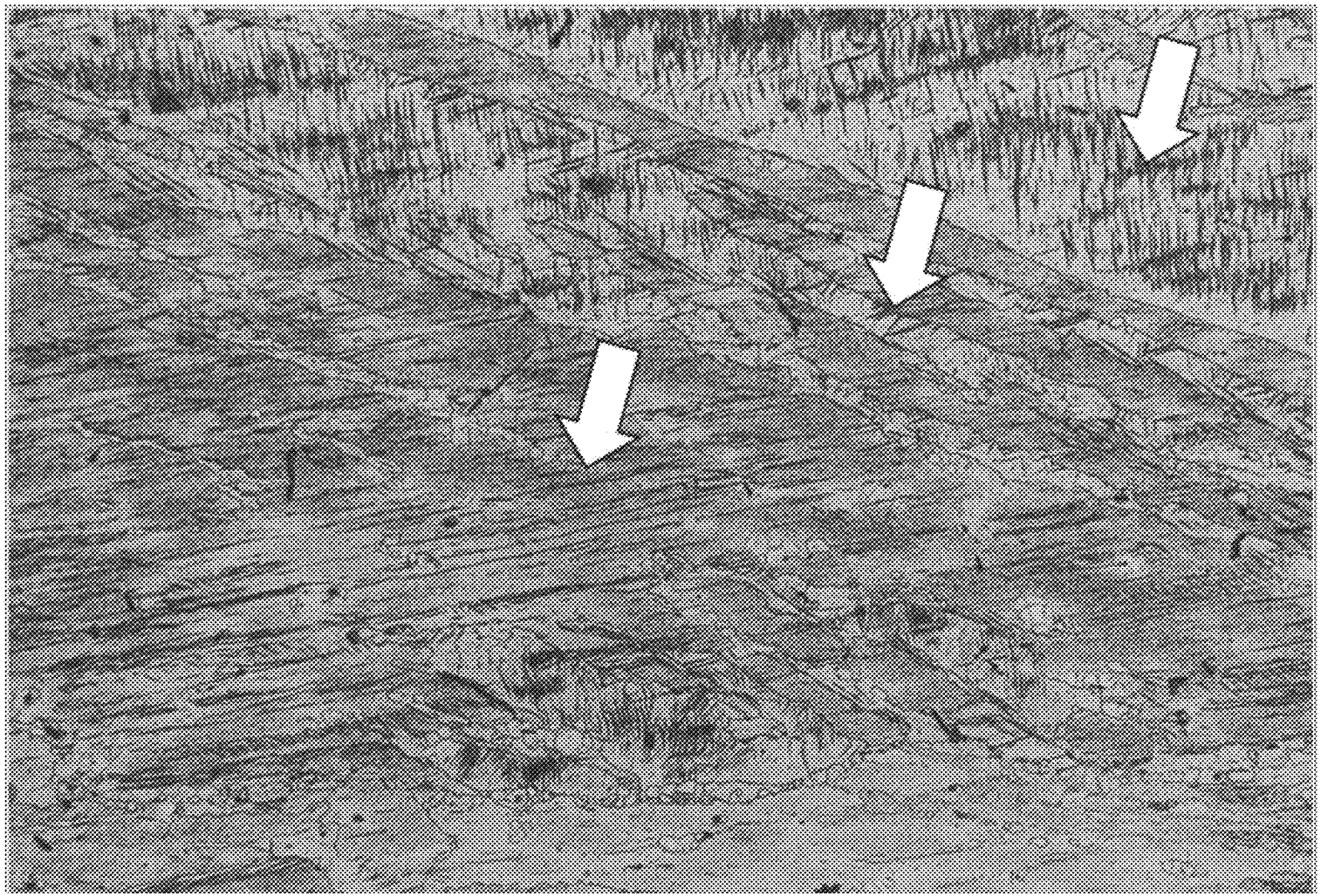
FIG. 3 is a microscopy image of an example extruded billet prepared from a coarse-grained magnesium alloy billet using an extrusion process having temperatures greater than or equal to about or exactly 300° C. to less than or equal to about or exactly 360° C. in accordance with various aspects of the present disclosure.
Figure 4:
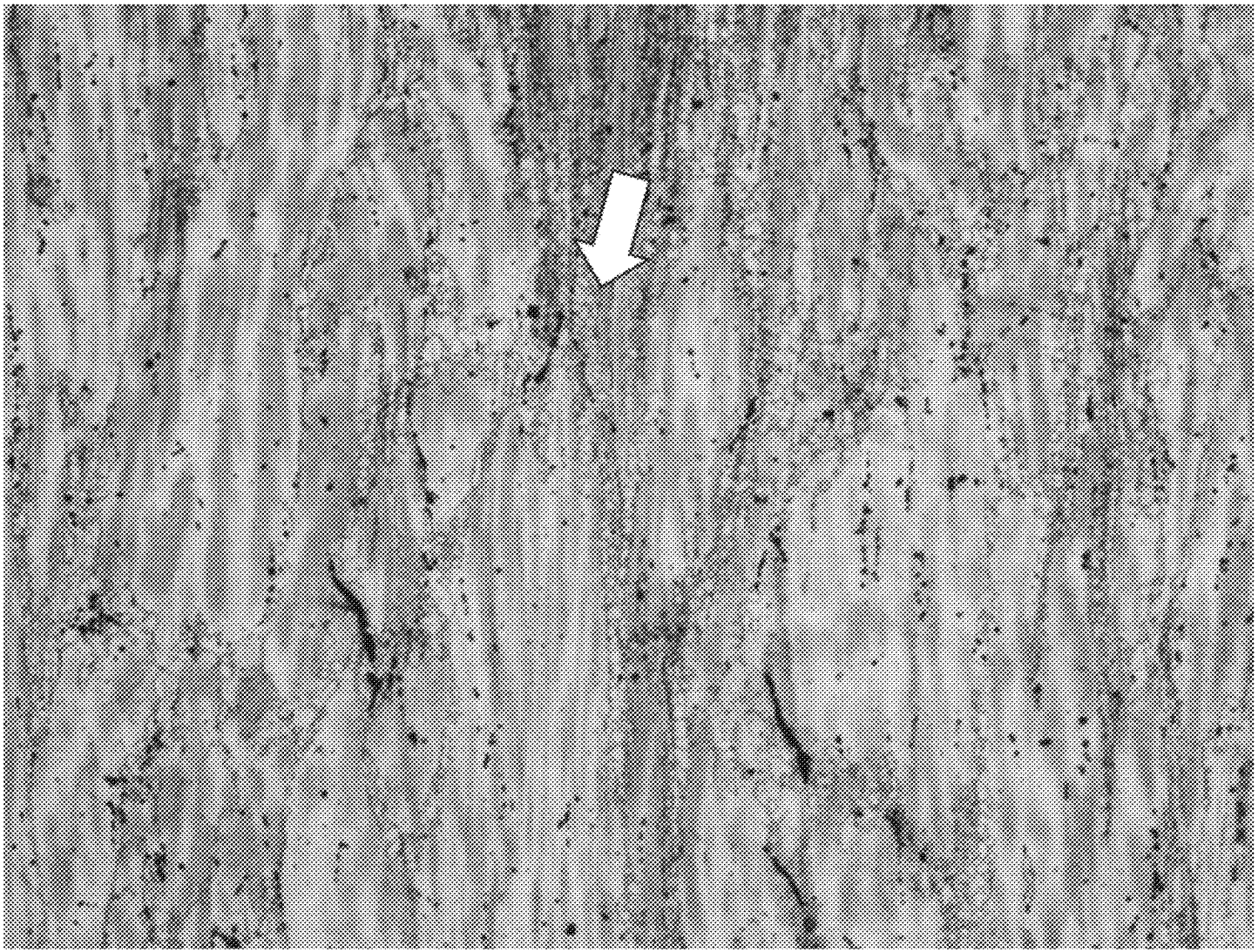
FIG. 4 is a microscopy image of an example extruded billet prepared from a coarse-grained magnesium alloy billet using an extrusion process having temperatures greater than or equal to about or exactly 380° C.

FIG. 3 is a microscopy image of an example extruded billet prepared using an extrusion process having temperatures greater than or equal to about or exactly 300° C. to less than or equal to about or exactly 360° C., where the plurality of twins in lenticular morphology. By way of comparison only, FIG. 4 is a microscopy image of an example extruded billet prepared using an extrusion process having temperatures greater than or equal to about or exactly 380° C. The white arrows in this instance identify instances of dynamic recrystallization of fine grains. In this instance, the area fraction of dynamic recrystallization of fine grains is less than or equal to about or exactly 10%.

Billets extruded from coarse-grained, low aluminum content magnesium alloys are particularly suitable for use to form components of an automobile or other vehicles (e.g., motorcycles, boats, tractors, buses, motorcycles, mobile homes, campers, and tanks), but they may also be used in a variety of other industries and applications, including aerospace components, consumer goods, devices, buildings (e.g., houses, offices, sheds, warehouses), office equipment and furniture, and industrial equipment machinery, agricultural or farm equipment, or heavy machinery, by way of non-limiting example. Non-limiting examples of automotive components or articles include hoods, pillars (e.g., A-pillars, hinge pillars, B-pillars, C-pillars, and the like), panels, including structural panels, door panels, and door components, interior floors, floor pans, roofs, exterior surfaces, underbody shields, wheels, control arms and other suspension, crush cans, bumpers, structural rails and frames, cross car beams, undercarriage or drive train components, and the like.

In various aspects, the present disclosure provides methods for forming articles or components from the extruded billets. For example, an example method for forming components includes forging the extruded billet. In certain variations, forging may include moving the extruded billet through a die having an opening or slit that matches a cross-sectional geometry of the component, such that the forged component moving out of the die has the cross-sectional geometry. In certain variations, the die may have a first half and a second half that together define the opening. The first half and the second half may be configured to apply a pressure to the extruded billet. For example, a pressure greater than or equal to about or exactly 50 KN to less than or equal to about or exactly 150 KN may be applied to the extruded billet. In certain variations, the forging may be performed by pushing the extruded billet through the die at a ram speed greater than or equal to about or exactly 1 mm/s to less than or equal to about or exactly 15 mm/s. Forging may occur at temperatures greater than or equal to about or exactly 350° C. to less than or equal to about or exactly 450° C. In certain variations, the method may include, following, the forging process, one or more flow forming processes, as would be recognized by the skilled artisan.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of forming an extruded billet from a coarse-grained magnesium alloy billet, the method comprising:

extruding the coarse-grained magnesium alloy billet at temperatures less than or equal to about 360° C. to form the extruded billet, the coarse-grained magnesium alloy billet having an average grain size greater than or equal to about 800 micrometers (μm) and comprising a plurality of twins with lenticular morphology.

2. The method of claim 1, wherein the coarse-grained magnesium alloy billet is extruded at temperatures greater than or equal to about 300° C.

3. The method of claim 1, wherein the coarse-grained magnesium alloy billet has a low aluminum content and comprises greater than or equal to about 1.5 wt. % to less than or equal to about 3 wt. % of aluminum.

4. The method of claim 3, wherein the coarse-grained magnesium alloy billet comprises about 2 wt. % of aluminum.

5. The method of claim 3, wherein the coarse-grained magnesium alloy billet further comprises greater than or equal to about 0.3 wt. % to less than or equal to about 0.6 wt. % of manganese.

6. The method of claim 5, wherein the coarse-grained magnesium alloy billet comprises about 0.5 wt. % of manganese.

7. The method of claim 3, wherein the coarse-grained magnesium alloy billet further comprises at least one of:

greater than 0 wt. % to less than or equal to about 3 wt. % of zinc;

greater than 0 wt. % to less than or equal to about 3 wt. % of tin;

greater than 0 wt. % to less than or equal to about 0.5 wt. % of calcium; and greater than 0 wt. % to less than or equal to about 5 wt. % of rare earth metals.

8. The method of claim 7, wherein the coarse-grained magnesium alloy billet comprises about 1 wt. % of zinc.

9. The method of claim 1, wherein the plurality of twins occupy an area fraction greater than or equal to about 20% of a total area of the billet.

10. A method of forming a forged component, the method comprising:

forging an extruded billet to form the forged component, the extruded billet prepared from a coarse-grained magnesium alloy billet by extruding the coarse-grained magnesium alloy billet at temperatures less than or equal to about 360° C. to form the extruded billet, the coarse-grained magnesium alloy billet having an average grain size greater than or equal to about 800 micrometers (μm) and comprising:

greater than or equal to about 0.3 wt. % to less than or equal to about 0.6 wt. % of manganese;

greater than or equal to about 0 wt. % to less than or equal to about 3 wt. % of zinc;

greater than or equal to about 0 wt. % to less than or equal to about 3 wt. % of tin;

greater than or equal to about 0 wt. % to less than or equal to about 0.5 wt. % of calcium; and greater than or equal to about 0 wt. % to less than or equal to about 5 wt. % of rare earth metals.

11. The method of claim 10, wherein the forging comprises moving the extruded billet through a forging die having an opening that corresponds to a desired cross-sectional geometry of the forged component.

12. The method of claim 10, wherein the extruding is conducted at temperatures greater than or equal to about 300° C.

13. The method of claim 10, wherein the coarse-grained magnesium alloy billet comprises greater than or equal to about 1.5 wt. % to less than or equal to about 3 wt. % of aluminum.

14. The method of claim 10, wherein the forged component comprises a plurality of twin-induced dynamic recrystallization grains, the twin-induced dynamic recrystallization grains occupying an area fraction greater than or equal to about 20% of a total area of the forged component.

15. The method of claim 14, wherein the forged component comprises greater than or equal to about 20% of boundaries with misorientations of greater than or equal to about 60 degrees to less than or equal to about 100 degrees.

16. A method of forming an extruded billet from a coarse-grained magnesium alloy billet, the method comprising:

moving the coarse-grained magnesium alloy billet through an extruding die at temperatures greater than or equal to about 300° C. to less than or equal to about 360° C. to form the extruded billet, the coarse-grained magnesium alloy billet comprising greater than or equal to about 0.5 wt. % to less than or equal to about 3 wt. % of aluminum and having an average grain size greater than or equal to about 800 micrometers (μm), and the extruded billet comprising a plurality of twins with lenticular morphology, the plurality of twins with lenticular morphology occupying an area fraction greater than or equal to about 20% of a total area of the extruded billet.

17. The method of claim 16, wherein the coarse-grained magnesium alloy further comprises:

greater than or equal to about 0.3 wt. % to less than or equal to about 0.6 wt. % of manganese.

18. The method of claim 16, wherein the coarse-grained magnesium alloy further comprises at least one of:

greater than 0 wt. % to less than or equal to about 3 wt. % of zinc;

greater than 0 wt. % to less than or equal to about 3 wt. % of tin;

greater than 0 wt. % to less than or equal to about 0.5 wt. % of calcium; and greater than 0 wt. % to less than or equal to about 5 wt. % of rare earth metals.

* * * * *